US006893140B2

(12) United States Patent
Storey et al.

(10) Patent No.: US 6,893,140 B2
(45) Date of Patent: May 17, 2005

(54) FLASHLIGHT

(75) Inventors: William T. Storey, Dalmatia, PA (US); Brian E. Probst, Renovo, PA (US); Joseph E. Gorrie, Klingertown, PA (US)

(73) Assignee: W. T. Storey, Inc., Dalmatia, PA (US)

( * ) Notice: Subject to any disclaimer, the term of this patent is extended or adjusted under 35 U.S.C. 154(b) by 311 days.

(21) Appl. No.: 10/318,725

(22) Filed: Dec. 13, 2002

(65) Prior Publication Data

US 2004/0114358 A1 Jun. 17, 2004

(51) Int. Cl.[7] ..... F21V 7/04; F21L 4/00

(52) U.S. Cl. ..... 362/191; 362/301; 362/302; 362/303; 362/304; 362/346

(58) Field of Search ..... 362/191, 190, 362/202, 205, 297, 300, 301, 302, 303, 304, 305, 346, 800, 287, 427

(56) References Cited

U.S. PATENT DOCUMENTS

| | | | | |
|---|---|---|---|---|
| 1,871,629 | A | | 8/1932 | McMenamin |
| 4,001,667 | A | | 1/1977 | Bober |
| 4,037,096 | A | * | 7/1977 | Brendgord et al. ..... 362/294 |
| 4,144,478 | A | | 3/1979 | Nuver |
| 4,166,947 | A | | 9/1979 | Dirksen |
| 4,177,500 | A | | 12/1979 | Nicholl et al. |
| 4,355,350 | A | | 10/1982 | Mader |
| 4,420,800 | A | | 12/1983 | Van Horn |
| 4,420,801 | A | | 12/1983 | Reiling et al. |
| 4,504,889 | A | | 3/1985 | Goldfarb |
| 4,571,506 | A | | 2/1986 | Lisco |
| 4,580,293 | A | | 4/1986 | Reichle |
| 4,876,632 | A | | 10/1989 | Osterhout et al. |
| 5,015,918 | A | | 5/1991 | Copeland |
| 5,061,861 | A | | 10/1991 | Sameshima et al. |
| 5,103,381 | A | | 4/1992 | Uke |
| 5,115,147 | A | | 5/1992 | Kusano et al. |
| 5,136,491 | A | | 8/1992 | Kano |
| 5,258,897 | A | | 11/1993 | Nino |
| 5,278,731 | A | * | 1/1994 | Davenport et al. ..... 362/551 |
| 5,406,462 | A | | 4/1995 | Fallahi et al. |
| 5,438,485 | A | * | 8/1995 | Li et al. ..... 362/558 |
| 5,459,649 | A | | 10/1995 | Ellion |
| 5,630,661 | A | | 5/1997 | Fox |
| 5,639,153 | A | * | 6/1997 | Bibbiani et al. ..... 362/551 |
| 5,682,448 | A | | 10/1997 | Riser |
| 5,742,133 | A | | 4/1998 | Wilhelm et al. |
| 5,806,962 | A | | 9/1998 | Ellion |
| 5,871,272 | A | | 2/1999 | Sharrah et al. |
| 5,894,196 | A | | 4/1999 | McDermott |
| 5,909,062 | A | | 6/1999 | Krietzman |
| 5,954,416 | A | | 9/1999 | Peterson |
| 5,957,567 | A | | 9/1999 | Kish et al. |
| 6,046,572 | A | | 4/2000 | Matthews et al. |
| 6,048,084 | A | | 4/2000 | Sedovic et al. |
| 6,095,661 | A | | 8/2000 | Lebens et al. |
| 6,170,960 | B1 | | 1/2001 | Maglica |
| 6,190,020 | B1 | | 2/2001 | Hartley |
| 6,331,062 | B1 | | 12/2001 | Sinclair |
| 6,386,730 | B1 | | 5/2002 | Matthews |
| 6,400,101 | B1 | | 6/2002 | Biebl et al. |
| 6,428,182 | B1 | | 8/2002 | Maglica |
| 6,485,160 | B1 | | 11/2002 | Sommers et al. |
| 6,536,921 | B1 | * | 3/2003 | Simon ..... 362/277 |

* cited by examiner

*Primary Examiner*—Thomas M. Sember
(74) *Attorney, Agent, or Firm*—Thomas R. Shaffer, Esq.

(57) ABSTRACT

A flashlight is disclosed which includes a housing adapted to receive one or more battery cells and having a transparent lens on a forward end thereof. An LED light source connected to the cell is utilized in conjunction with collimating optics positioned adjacent the LED to refract rays of light from the LED forwardly. A first paraboloid reflector having a concave reflective surface is positioned within said housing to receive rays of light from the collimating optics and to reflect the rays rearwardly and a second paraboloid reflector having a concave reflective surface is positioned within said housing to receive rays of light reflected rearwardly from the first paraboloid reflector and to further reflect the rays forwardly through the transparent lens.

21 Claims, 4 Drawing Sheets

FLASHLIGHT

BACKGROUND OF THE INVENTION

1. Field of the Invention

The present invention relates to a flashlight. More specifically, it relates to an extremely durable and long lasting flashlight utilizing a light emitting diode (hereinafter "LED") light source in combination with a pair of paraboloid reflectors making the flashlight particularly useful for police, fire, rescue and emergency services workers and military personnel.

2. Description of the Prior Art

A variety of prior art flashlights have been proposed.

Matthews, U.S. Pat. No. 6,386,730, discloses a flashlight having a head with two merged yet independent lamp/reflector systems. While Matthews teaches the provision of two reflectors, both reflectors are simply used to independently focus light from two light sources into the forwardly directed beam configurations.

McDermott, U.S. Pat. No. 5,894,196, discloses a compact lighting device including a light concentrating reflector directing light emitted by a light source toward a curved light refracting surface where it is refracted and thereby redirected. McDermott teaches the generation of substantially elliptical patterns of light.

Sharrah et al., U.S. Pat. No. 5,871,272, discloses a flashlight having a lamp head including a reflector having a major paraboloid reflective surface and a minor reflective paraboloid surface not interacting on the same light source.

Matthews et al., U.S. Pat. No. 6,046,574, discloses a flashlight having a first cell or set of cells (batteries) arranged in a first pattern and alternatively a second cell or set of cells (batteries) arranged in a second pattern with switching between or interconnecting the two cells or sets of cells disclosed. An on off switch is provided which includes a push button switch and a rotary switch that blocks the on off push button switch. A momentary on switching function is provided. A flashlight beam is cast with a first lamp and reflector and an alternative second lamp and reflector assembly is substituted for the first lamp and reflector to provide a different configuration of beam illumination.

Lebens et al., U.S. Pat. No. 6,095,661, discloses an LED flashlight which includes a control circuit that selectively applies power from a source of electric power to the LEDs, thus maintaining or controlling the light output level of the LEDs at a generally constant level as the charge on the battery cell varies.

Copeland, U.S. Pat. No. 5,015,918, discloses a bicycle lighting system utilizing red LEDs which includes a means to maintain the charging current at a relatively constant average value thus supplying a constant current and power to the LEDs.

Krietzman, U.S. Pat. No. 5,909,062, provides an LED flashlight which has a second or redundant battery supply which nests in-line in a tubular or oval housing.

Sinclair, U.S. Pat. No. 6,331,062, discloses a portable electric LED flashlight having a light source in the form of an LED with a high internal resistance. The use of such a high resistance element, while initial costs are low, is undesirable as it unnecessarily wastes battery power.

There remains a need for a high intensity light LED powered flashlight which is highly efficient and long lasting for use by fire fighting personnel, law enforcement personnel, EMS personnel and civilians and the like.

SUMMARY OF THE INVENTION

The present invention provides a flashlight which, in its preferred form, is intended to run continuously over a 10 hour period or more on one set of "D" cells or over 20 hours on 2 sets. It will be obvious that any size of cells can be utilized and it currently contemplated that a smaller version of the flashlight which utilizes 2 sets of "AA" cells would be of particular utility although, with smaller cells, the number of hours of continuous illumination without replacement of cells would be significantly fewer. A second microprocessor controlled circuit allows the flashlight to switch from one set of cells to the other, which provides uninterrupted use. An indicator is provided to show which set of cells is in use and, preferably, to also show the degree to which such cells have been drained. A new set of cells can replace the drained set while the flashlight is in use. A microprocessor circuit also allows the light to remain bright white throughout the life of the cells. The flashlight uses a pair of paraboloid reflectors that work together to focus the light into a concentrated beam. The housing of the flashlight is made from a high strength polycarbonate material. An emergency strobe light is preferably imbedded into the handle of the flashlight. A sliding thumb switch activates the LED or the strobe. The switch is hermetically sealed to enable the unit to be water resistant. The flashlight can be placed in several positions using a multi-position stand which is mounted to the bottom of the housing. The multi-position stand also features a retractable stainless steel split ring to allow the user to attach the flashlight to many devices including the key ring holders that many of the above personnel utilize. The split ring may be used in conjunction with the multi-position stand to suspend the flashlight in a variety of positions. The flashlight is preferably sealed with o-rings making the flashlight water resistant.

The present invention has a number of specific objects and features including but not limited to the following:

Presently, a single one watt bright white LED light source is preferred. A five watt bright white LED light source is also contemplated.

The LED light source is intended to have a long operating life of up to 100,000 hours.

It is an object of the invention to provide a flashlight which provides non-dimming light throughout the life of the cells.

It is an object of the invention to utilize two paraboloid focusing reflectors to direct a concentrated light beam.

It is an object of the invention to utilize two sets of cells with one working set and one auto switched back-up set.

It is an object of the present invention to provide the switching from one cell set to the other with a microprocessor controlled circuit.

It is also an object of the invention to utilize a second microprocessor controlled circuit to maintain a generally constant LED current with thermal input over a temperature range of approximately −40° to 120° F.

It is an object of the invention to allow for the replacement of one set of cells without interruption of the light.

It is an object of the invention to provide an emergency strobe light imbedded in the housing or the handle of the flashlight.

It is an object of the invention to provide a hermetically sealed switch.

It is an object of the invention to provide a multi-position stand which is pivotally mounted for 180 degrees of rotation.

And it is an object of the invention to provide a retractable stainless steel split ring for belt attachment or the like.

The flashlight of the present invention preferably comprises a housing adapted to receive at least one cell and having a transparent lens on a forward end thereof; an LED light source adapted to be connected to said at least one cell, said LED light source when energized emitting rays of light in a generally hemispherical light pattern; collimating optics positioned adjacent said LED to direct (by refraction or reflection or both) said rays of light into a first generally cylindrical pattern of light with light rays being generally parallel to one another and directed in a forward direction along an optical axis; a first paraboloid reflector having a concave reflective surface positioned within said housing and preferably attached to an inner side of said transparent lens, said first paraboloid reflector having a focus point positioned on said optical axis and positioned to receive rays of light from said first generally cylindrical pattern of light and to reflect said rays rearwardly generally through said focus point; and a second paraboloid reflector having a concave reflective surface positioned within said housing and having a focus point positioned on said optical axis to receive rays of light reflected rearwardly from said first paraboloid reflector and to further reflect said rays into a second generally cylindrical pattern of light with light rays being generally parallel to one another and directed in a forward direction along an optical axis and out of the housing through said transparent lens.

Preferably said focus point of said first paraboloid reflector and said focus point of said second paraboloid reflector are located at the same point along said optical axis.

Preferably, said at least one cell further comprises at least two cells which are controlled by a first microprocessor control circuit to independently energize said LED light source at different times. Preferably said at least one cell further comprises at least two pairs of cells.

The flashlight of the present invention preferably has a housing which further comprises a stand pivotally mounted thereon. Said stand preferably may rotate though 180 degrees of rotation to allow said flashlight when laid upon a surface to selectively direct light a number of different directions. Preferably, said stand further comprises at least two toothed disks urged together by at least one wave spring washer whereby said stand is restrained from pivotal motion by said toothed disks unless force is applied to said stand sufficient to overcome the force applied by said wave spring washer. Said stand also preferably includes a spring loaded ring which is urged to remain in a secured location which prevents rotation thereof absent the application of force and upon the application of force said ring moves away from said secured location and is free to rotate relative to said stand.

The flashlight housing preferably includes a handle for carrying said flashlight.

Preferably, the flashlight also further comprises a strobe light in said housing or in said handle.

The flashlight preferably has a switch to selectively energize said LED light source. The switch is preferably a four position switch including an LED on position, a spring loaded momentary LED on position, an off position and a strobe on position. The switch is preferably hermetically sealed.

A second microprocessor control circuit is preferably provided to produce a generally constant electrical current to the LED light source. Preferably, such circuit provides a generally constant current over a range of temperatures between −40 degrees F. to 120 degrees F. Finally, the LED light source is preferably mounted on a heat sink to remove heat from said LED light source.

DETAILED DESCRIPTION OF THE PREFERRED EMBODIMENTS

Figure 1:
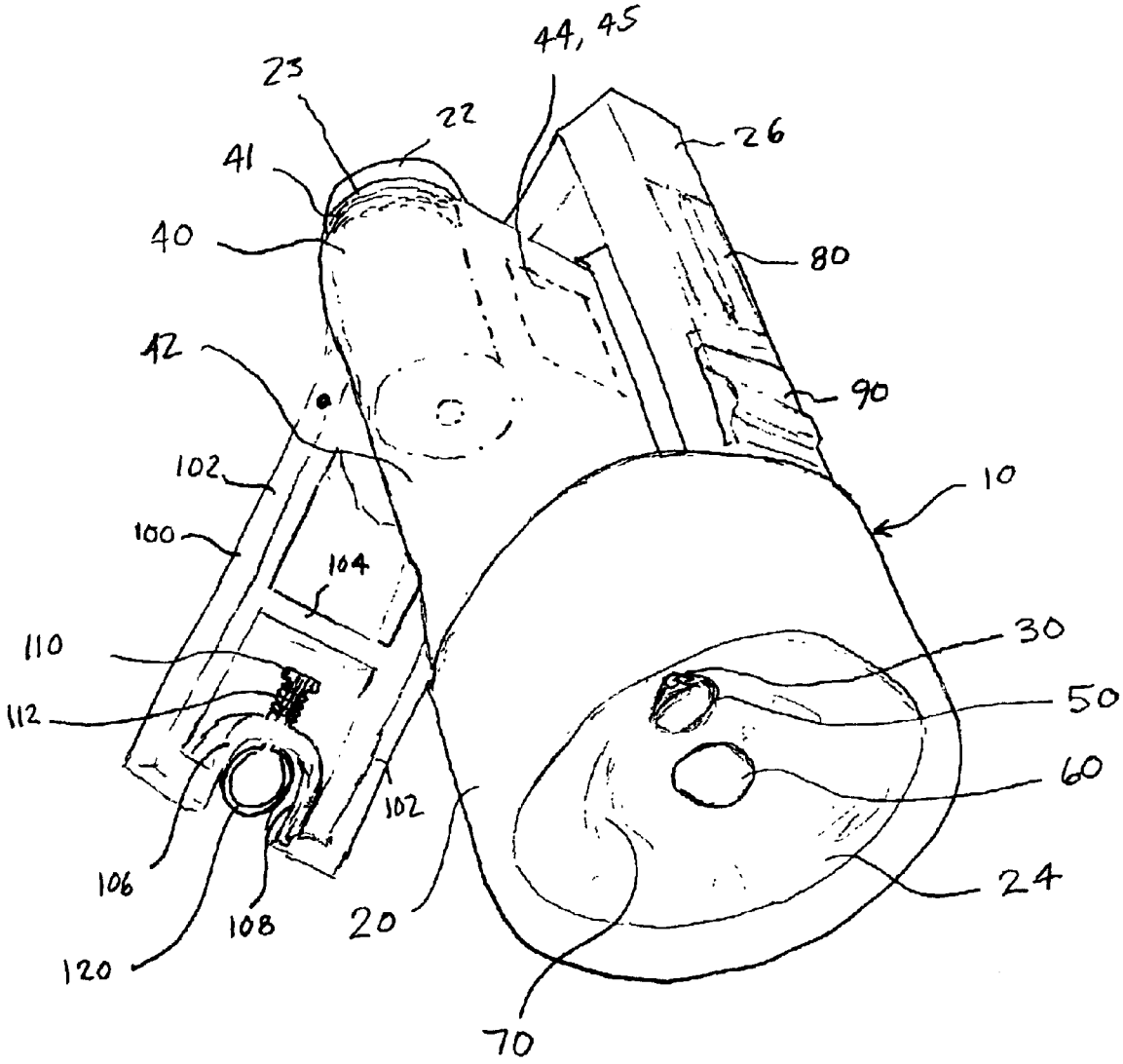
FIG. 1 is an isometric view of the front of the flashlight of the present invention.

Referring to the figures, the flashlight 10 has a housing 20. The housing 20 has a cell compartment 42 which can be accessed by a pair of end caps 22. A rubber o-ring 23 is preferably provided on each end cap 22 to provide a water resistant means to enclose the cells 40 within the housing 20. A pair of cylindrical (rather than typical conical) shaped coil springs 41 are utilized to firmly hold the cells 40 in electrical contact with the necessary components to illuminate LED 30 or strobe 80 when desired. The housing 20 also includes a transparent lens 24 on the front end of the housing and a carrying handle 26 is provided.

A one watt bright white light LED light source 30 is provided. Collimating optics 50 are attached adjacent said LED light source 30. A first paraboloid reflector 60 is provided on an inner surface of transparent lens 24. Depending upon the desired location for the focus point F1 of the first paraboloid reflector 60, however, it may be necessary to mount said first paraboloid reflector with the housing 20 at a location rearwardly of the inner surface of transparent lens 24. As is well known, the location of focal point F1 will be closer to the first paraboloid reflector if the curvature of the paraboloid reflector is great and further away as the curvature becomes more flattened with F1 located at infinity with a planar paraboloid surface.

Figure 2:
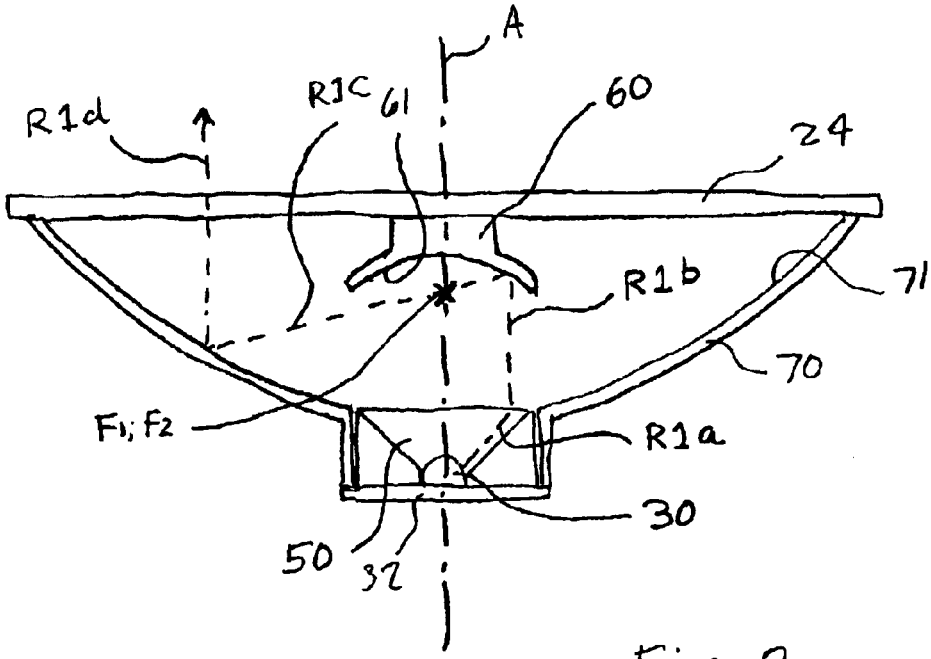
FIG. 2 is a cross sectional view showing the collimating optics, first paraboloid reflector and second paraboloid reflector and a single ray of light directed thereby.
Figure 3:
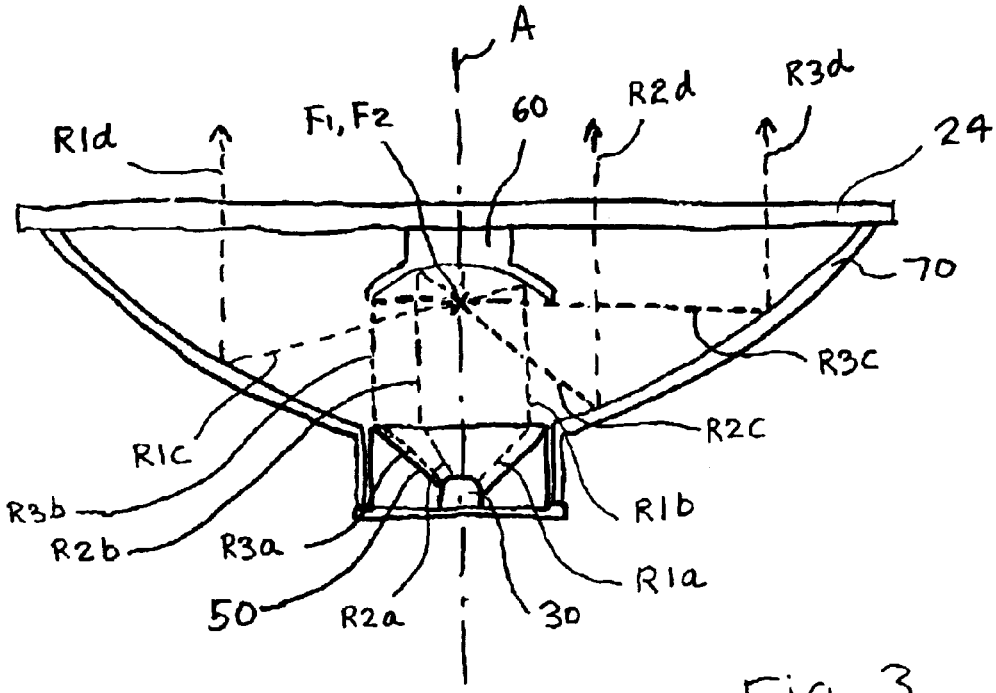
FIG. 3 is a cross sectional view of the collimating optics, first paraboloid reflector and second paraboloid reflector showing the paths of three different rays of light.
Figure 5:
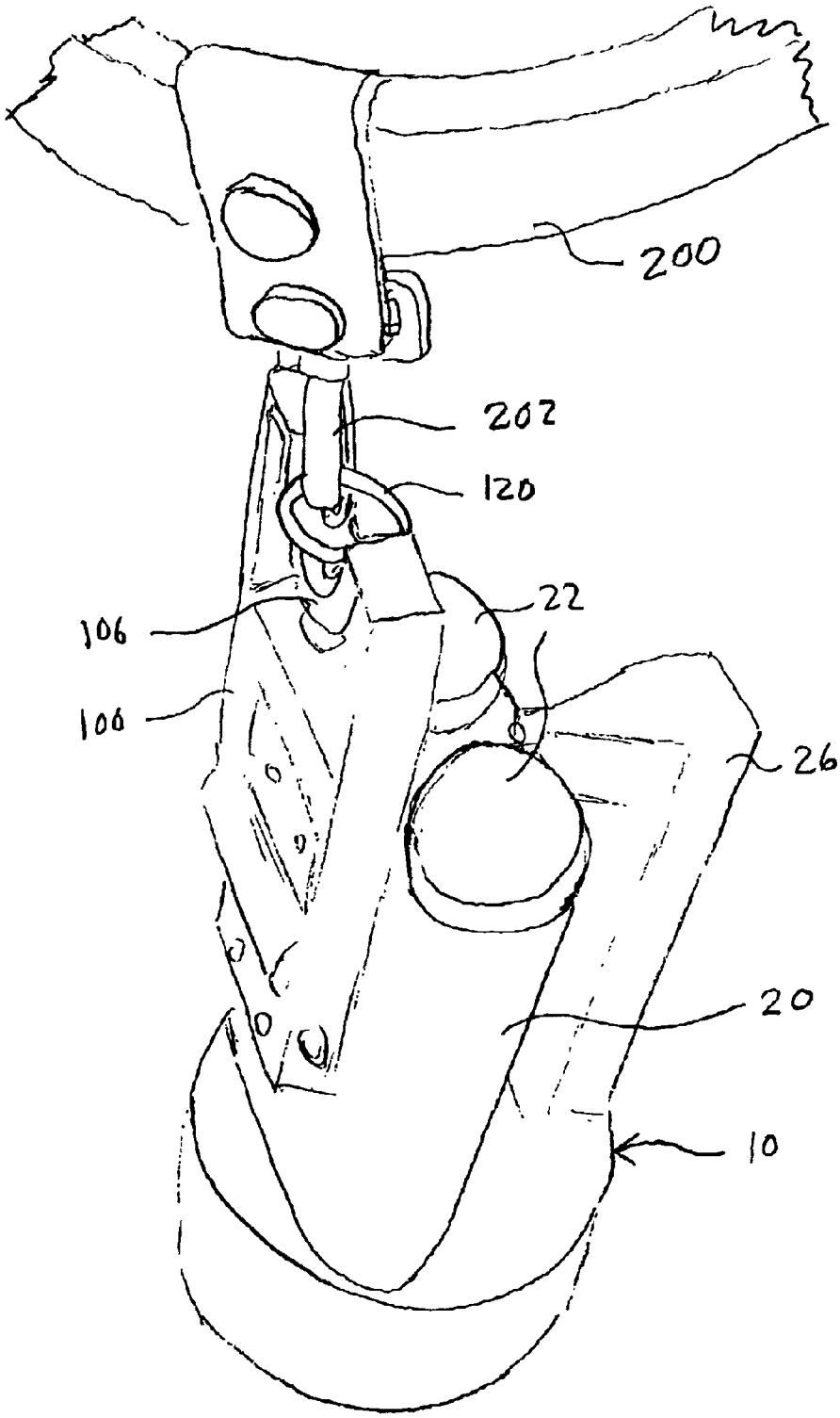
FIG. 5 is an isometric view showing the flashlight attached to the belt of an emergency services worker.

A second paraboloid reflector 70 is also provided on the inner surface of transparent lens 24 as best shown in FIGS. 2 and 3. A multi-position stand 100 is mounted to the lower side of housing 20. The multipurpose stand 100 includes a pair of legs 102, a cross member 104 and a front end portion 106 formed in a semi-annular configuration. The front end portion 106 includes a semi-annular groove 108 which is adapted to receive a stainless steel split ring 120. A split ring 120 is attached to a release button 110 which is urged by spring 112 to secure ring 120 in groove 108. When outward force is applied to ring 120, ring 120 moves outwardly away from end 106 and is then free to rotate as it is then outside of groove 108. The rotation of ring 120 is best shown in FIG. 5. FIG. 1 shows ring 120 as secured in groove 108.

Figure 4:
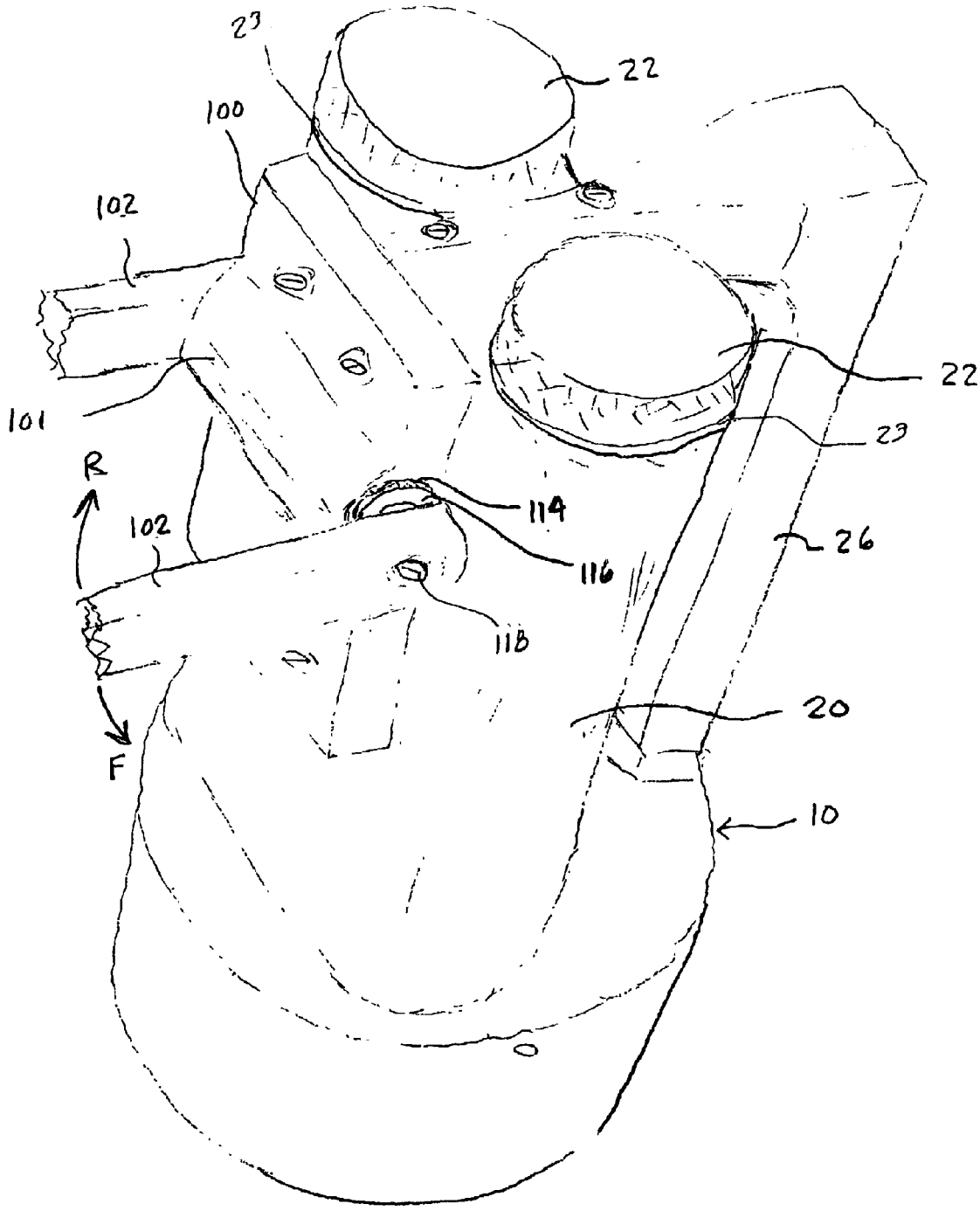
FIG. 4 is an isometric view showing the rear of the flashlight of the present invention.

FIG. 5 shows the ring 120 attached to an emergency service worker's utility belt 200 by means of a clip 202. It is noted that the stand 100 is adapted to rotate through 180° of rotation. When rotated rearwardly in the direction of arrow R shown in FIG. 4, the stand may extend outwardly from the rear of the flashlight as shown in FIG. 5. When the stand is moved forwardly in the direction of arrow F in FIG.

4, it is adapted to lie flat against the lower portion of the housing 20 to allow the flashlight to have a compact storage configuration. A variety of intermediate positions can be selected so that the light from the flashlight may be directed in a desired direction.

The legs 102 are pivotally mounted in the base 101 of stand 100 by means of a screws or rivets 118. A pair of toothed discs 114 in combination with a wave spring washer 116 are utilized to restrain the stand from pivotal motion unless forces applied to said stand sufficient to overcome the force applied by said wave spring washer. This allows any one of a desired of rotational positions to be selected and for the stand to remain firmly affixed to said selected position until sufficient force is applied to move it to a different position.

The handle 26 on the flashlight preferably has a strobe light 80 embedded therein as shown in FIG. 1. A hermetically sealed four position thumb switch 90 is also provided on handle 26.

A first microprocessor controlled circuit 44 is provided to control the switching from one set of cells to the other. A second microprocessor controlled circuit 45 is provided to provide generally constant current to the LED 30 over a broad range of temperatures.

Referring now specifically to FIGS. 2 and 3, the LED 30 is provided on a heat sink 32 and collimating optics 50 are provided adjacent thereto. Preferably, the LED and collimating optics are assembled as a single unit such as, for example, the commercially available product sold under the trademark "LUXEON STAR/O" which is the presently preferred LED light source/collimating optics element. The first paraboloid reflector 60 and the second paraboloid reflector 70 are preferably formed of molded plastic and are then metallized by either a vacuum metallization process or by sputtering to create a highly reflective paraboloid surfaces 61 and 71, respectively.

FIG. 2 specifically shows the path of a ray of light identified as R1 as it travels from the light source 30 until the time that it passes forwardly through the transparent lens 24. Ray R1 first travels radially outward from source 30 as shown by segment R1A. The collimating optics 50 utilize the principals of refraction and reflection to direct the R1 into a path R1B which is parallel to an optical axis labeled A. Ray R1 at the end of segment R1B strikes the metallized surface 61 of the first paraboloid reflector 60 is reflected through a focus F1 of said paraboloid reflector 60 onto the metallized surface 71 of the second paraboloid reflector 70. This path is designated as R1C. Ray R1 is then finally reflected off of said surface 71 of the second paraboloid reflector in the forward direction of segment R1D. Segment R1D is also parallel to the optical axis A. As shown in FIG. 2, the focus F1 of the paraboloid reflector 60 is shown to be located in the same position as the focus F2 of the second paraboloid reflector 70 which is the presently preferred embodiment of the invention. Both of these focuses F1 and F2 are located on the optical axis A. It is also contemplated that F1 and F2 may be located at different spaced apart locations on the optical axis A.

FIG. 3 shows a similar pathway for three rays of light designated respectively as R1, R2 and R3. As can be seen by looking at segments R1B, R2B and R3B, as the light rays R1, R2 and R3 leave the collimating optics element 50, such rays of light form a first generally cylindrical pattern of light which is directed toward the first paraboloid reflector 60. It can also be seen that after being reflected off from second paraboloid reflector 70 said rays of light R1, R2 and R3 form a second generally cylindrical pattern of light, as shown by ray segments R1D, R2D and R3D.

Said second generally cylindrical pattern of light forms a concentrated beam of light which provides uniform illumination over the entire circular area to which the cylindrical beam of light is directed. Obviously, because of imperfections in the optics and because of refraction which occurs at each surface, the light beam is not limited solely to the cylindrical beam described herein and some portion of the light generated by said light source 30 will spread over a larger area.

While it is preferred that the collimating optics 50 generate a first generally cylindrical pattern of light rays and that the second paraboloid reflector 70 generate a second generally cylindrical pattern if light rays, such light patterns are not required. While such cylindrical patterns of light rays are believed to provide the greatest degree of concentrated illumination at the greatest distance, it is also contemplated that some situations may desirably require a larger area to be generally illuminated rather than providing only a concentrated beam of light rays. By varying the shape of the paraboloid reflectors (and location of F1 and F2) it is a simple modification to cause said second generally cylindrical pattern of light to be altered to form a generally conical pattern of light, thus allowing for illumination of a larger area. It is also contemplated that by providing a means to move to location of one or more of the paraboloid reflectors along the optical axis (and the location of F1 or F2) it is possible to allow for an adjustment of the concentration of the beam from the flashlight from a narrow to a wide beam by methods which are well known in the art.

Because of the use of a low energy LED coupled with the unique arrangement of paraboloid reflectors and independent dual power supply, the present invention provides an extremely useful flashlight for fire, police and other emergency service workers. The light is intended to provide illumination during an extended period without interruption. Further, since cells can be replaced on the fly without turning the light off, no interruption of illumination will occur. The provision of a strobe light in the handle makes an extremely effective signal to mark danger or to allow emergency helicopters to locate the sight of an emergency event. Finally, because of the durability of each of the components utilized, the flashlight will continue to provide illumination even when subjected to substantial trauma, abuse or adverse conditions.

While we have shown and described the presently preferred embodiment of our invention, the invention is not limited thereto and may be otherwise variously practiced within the scope of the following claims:

We claim:

1. A flashlight comprising:

a) a housing having at least one cell and having a transparent lens on a forward end thereof;

b) an LED light source connected to said at least one cell;

c) collimating optics positioned adjacent said LED to refract said rays of light forwardly;

d) a first paraboloid reflector having a concave reflective surface positioned within said housing to receive rays of light from said collimating optics and to reflect said rays rearwardly;

e) a second paraboloid reflector having a concave reflective surface positioned within said housing to receive rays of light reflected rearwardly from said first paraboloid reflector and to further reflect said rays forwardly through said transparent lens.

2. A flashlight according to claim 1 wherein said collimating optics directs said rays of light into a first generally cylindrical pattern of light and said second paraboloid reflector further reflects said rays into a second generally cylindrical pattern of light.

3. A flashlight according to claim 1 wherein said first paraboloid reflector is attached to an inner side of said transparent lens.

4. A flashlight according to claim 1 wherein said at least one cell further comprises at least two cells which are controlled by a first microprocessor control circuit to independently energize said LED light source at different times.

5. A flashlight according to claim 4 wherein said at least one cell further comprises at least two pair of cells.

6. A flashlight according to claim 1 wherein said housing further comprises a stand pivotally mounted thereon.

7. A flashlight according to claim 6 wherein said stand may rotate though 180 degrees of rotation to allow said flashlight when laid upon a surface to selectively direct light a number of different directions.

8. A flashlight according to claim 6 wherein said stand further comprises at least two toothed disks urged together by at least one wave spring washer whereby said stand is restrained from pivotal motion by said toothed disks unless force is applied to said stand sufficient to overcome the force applied by said wave spring washer.

9. A flashlight according to claim 6 wherein said stand includes a spring loaded ring which is urged to remain in a secured location which prevents rotation thereof absent the application of force and upon the application of force said ring moves away from said secured location and is free to rotate relative to said stand.

10. A flashlight according to claim 1 wherein said housing includes a handle for carrying said flashlight.

11. A flashlight according to claim 1 further comprising a strobe light in said housing.

12. A flashlight according to claim 1 further comprising a switch to selectively energize said LED light source.

13. A flashlight according to claim 12 wherein said switch is a four position switch including an LED on position, a spring loaded momentary LED on position, an off position and a strobe on position.

14. A flashlight according to claim 12 wherein said switch is hermetically sealed.

15. A flashlight according to claim 1 further comprising a second microprocessor control circuit to provide generally constant electrical current to the LED light source over a range of temperatures.

16. A flashlight according to claim 15 wherein said range of temperatures comprises a range between −40 degrees F. to 120 degrees F.

17. A flashlight according to claim 1 wherein said LED light source is mounted on a heat sink to remove heat from said LED light source.

18. A flashlight according to claim 17 further comprising a second heat sink to remove heat from said LED light source.

19. A flashlight according to claim 1 further comprising at least one generally cylindrical coil spring urging and holding said at least one cell in a desired position within said housing.

20. A flashlight comprising:

a) a housing having at least one cell and having a transparent lens on a forward end thereof;

b) an LED light source connected to said at least one cell, said LED light source when energized emitting rays of light in a generally hemispherical light pattern;

c) collimating optics positioned adjacent said LED to direct said rays of light into a first generally cylindrical pattern of light with light rays being generally parallel to one another and directed in a forward direction along an optical axis;

d) a first paraboloid reflector having a concave reflective surface attached to an inner side of said transparent lens, said first paraboloid reflector having a focus point positioned on said optical axis and positioned to receive rays of light from said collimating optics and first generally cylindrical pattern of light and to reflect said rays rearwardly generally through said focus point; and e) a second paraboloid reflector having a concave reflective surface positioned within said housing and having a focus point positioned on said optical axis to receive rays of light reflected rearwardly from said first paraboloid reflector and to further reflect said rays into a second generally cylindrical pattern of light with light rays being generally parallel to one another and directed in a forward direction along an optical axis and out of the housing through said transparent lens.

21. A flashlight according to claim 20 wherein said focus point of said first paraboloid reflector and said focus point of said second paraboloid reflector are located at the same point along said optical axis.

* * * * *